US005270778A

United States Patent [19]

Wyer

[11] Patent Number: 5,270,778

[45] Date of Patent: Dec. 14, 1993

[54] SHEET CURL CONTROL APPARATUS

[75] Inventor: Andrew F. Wyer, Comberton, England

[73] Assignee: Xerox Corporation, Stamford, Conn.

[21] Appl. No.: 970,451

[22] Filed: Nov. 2, 1992

[30] Foreign Application Priority Data

Dec. 12, 1991 [GB] United Kingdom ..... 9126401

[51] Int. Cl.[5] ..... G03G 15/00

[52] U.S. Cl. ..... 355/311; 162/271; 250/559; 271/272

[58] Field of Search ..... 355/207, 282, 311; 162/271; 439/8, 10, 459; 271/272; 250/559, 561, 562

[56] References Cited

U.S. PATENT DOCUMENTS 4,627,718 12/1986 Wyer ..... 355/311

FOREIGN PATENT DOCUMENTS 60-52459 3/1985 Japan ..... 355/311

*Primary Examiner*—Joan H. Pendegrass

[57] ABSTRACT

The invention relates to a sheet curl control apparatus including a decurler (350) for reducing the curl in sheet material passing therethrough and adjusting means coupled to the decurler (350) for adjusting the decurling action of the decurler (350). Sensing means (406) in the form of an infra-red emitter (408) and two infra-red detectors (410 and 412) are employed for sensing the extent of any residual curl left in the sheet material after it has passed through the decurler (350), and for feeding a signal indicative of the residual curl to control means, conveniently including a stepper motor, for automatically adjusting the adjusting means, for example a rack and pinion arrangement, thereby to alter the decurling action of the decurler (350) in a predetermined manner. The sheet curl control apparatus is described in relation to its use in a copier for duplex copying.

11 Claims, 9 Drawing Sheets

SHEET CURL CONTROL APPARATUS

The invention relates to sheet curl apparatus and more particularly, but not exclusively, to copiers incorporating such apparatus.

Curl may be induced into sheets of paper due to various handling factors and this may impair the further handling of the sheet. One way in which curl is induced unintentionally in sheets is in the process of transfer and fixing of an image to a sheet in a photocopier. This can particularly be a problem in a duplex copier where the sheet is to be conveyed to a duplex buffer tray from which it is transferred to the photoreceptor to receive an image on its other side. It may also be a problem where the sheet requires a further processing such as binding in a finisher. To this end various sheet curl apparatus have been devised.

One such known apparatus is disclosed in U.S. Pat. No. 4,627,718 which describes a decurler comprising a pair of coacting rolls that form a nip therebetween and a baffle positioned relative to the rolls so as to bend a sheet passing between the rolls about one of the rolls. The baffle extends from a position upstream of the nip to a position downstream thereof and extends across the downstream side of the nip between the rolls at an acute angle to the tangential line through the nip. The position of the baffle is adjustable in the feed direction of the sheets for adjusting the degree of paper wrap around the lower roll. A suitable manually adjustable mechanism is provided for this purpose. Despite the effectiveness of this decurler, the vast range of paper characteristics affecting curl varies so widely that manual adjustment limits the overall machine's ability to handle large numbers of paper types without constant attention.

An object of the present invention is to provide an improved sheet curl control apparatus which can automatically adjust a decurler so as to provide the decurler with a decurling action which more accurately matches the degree of expected curl present in the paper sheet before its entry into the decurler.

Accordingly, the present invention provides a sheet curl control apparatus including a decurler for reducing the curl in sheet material passing therethrough and adjusting means coupled to the decurler for adjusting the decurling action of the decurler, characterized by sensing means for sensing the extent of any residual curl left in the sheet material after it has passed through the decurler, and for feeding a signal indicative of the residual curl to control means for automatically adjusting said adjusting means thereby to alter the decurling action of the decurler in a predetermined manner.

In a preferred embodiment the sensing means is located adjacent a straight, preferably horizontal, section of sheet path downstream of said decurler.

In one embodiment, the sensing means comprises a radiation source and two radiation detectors for detecting radiation emitted by said radiation source, the detectors being spaced apart and arranged whereby movement of the sheet material along the sheet path downstream of said decurler causes the light beams reaching the detectors to be interrupted in succession by the feed edge of the sheet material, the time interval between interruption of the light beams at the two detectors being a function of the extent of residual curl in the sheet material.

In one embodiment the radiation source is located on one side of the straight section of sheet path downstream of said decurler and the detectors are spaced apart on the opposite side of the sheet path. In a preferred embodiment the radiation source is positioned above the sheet path and the detectors are positioned below the sheet path, the time interval between interruption of light at the detectors being inversely proportional to the sheet curl. Conveniently, the radiation source is an infra-red emitter and the detectors are each infra-red sensors.

In a further preferred embodiment, the control means includes a motor, for example a stepping motor, operable in response to the feedback signal from the sensing means to adjust said adjusting means. In one embodiment the adjusting means is a rack and pinion arrangement, the rack being mounted to a baffle of the decurler and the pinion being driven by a mechanical coupling arrangement to the drive shaft of the stepping motor.

In another aspect of the invention, there is provided a copier defining therein a sheet path having a sheet curl control apparatus arranged therealong including a decurler for reducing the curl in sheet material passing through the decurler, lead-in guide means for guiding the sheets into the decurler and adjusting means coupled to the decurler for adjusting the decurling action of the decurler, characterized in that the sheet curl control apparatus includes sensing means for sensing the extent of any residual curl left in the sheet material after it has passed through the decurler, and for feeding a signal indicative of the residual curl to control means for automatically adjusting said adjusting means thereby to alter the decurling action of the decurler in a predetermined manner.

In a further aspect of the invention, there is provided a copier for duplex copying including a photoreceptor, a copy sheet tray, a duplex buffer tray, sheet feeders associated with said trays for feeding sheets from said trays to the photoreceptor, a fuser for fixing images received on said sheets at the photoreceptor, a sheet return path for conveying simplex sheets which have received an image on one side at the photoreceptor to said duplex buffer tray from said fuser for refeeding to the photoreceptor to receive a second image on the other side and a sheet curl apparatus in the sheet return path, characterized in that the sheet curl control apparatus includes sensing means for sensing the extent of any residual curl left in the sheet material after it has passed through the decurler, and for feeding a signal indicative of the residual curl to control means for automatically adjusting said adjusting means thereby to alter the decurling action of the decurler in a predetermined manner.

The invention will now be described further, by way of example, with reference to the accompanying drawings in which.

Figure 1:
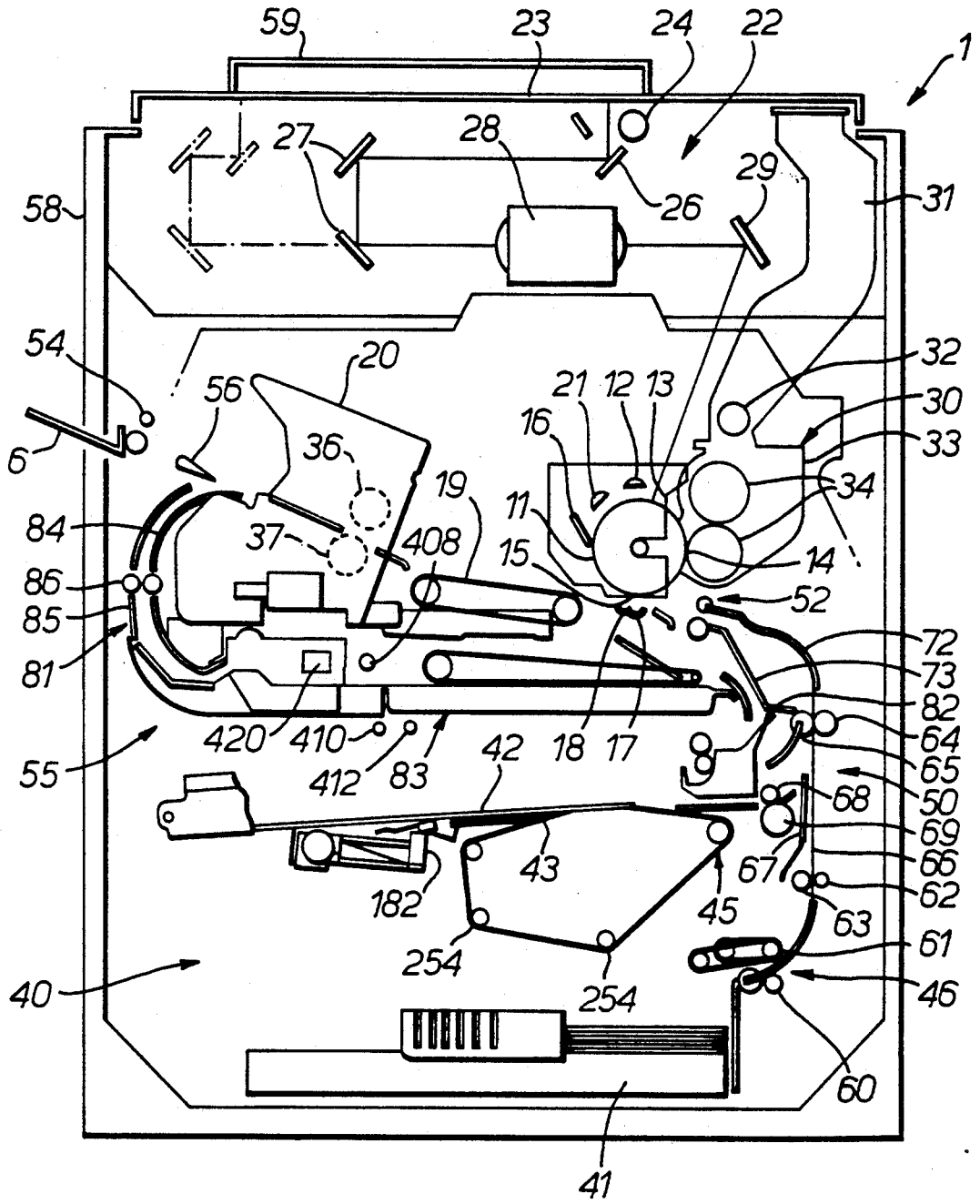
FIG. 1 is a schematic side elevational view of a duplex copying machine showing the operational elements thereof and incorporating an embodiment of the present invention.
Figure 2:
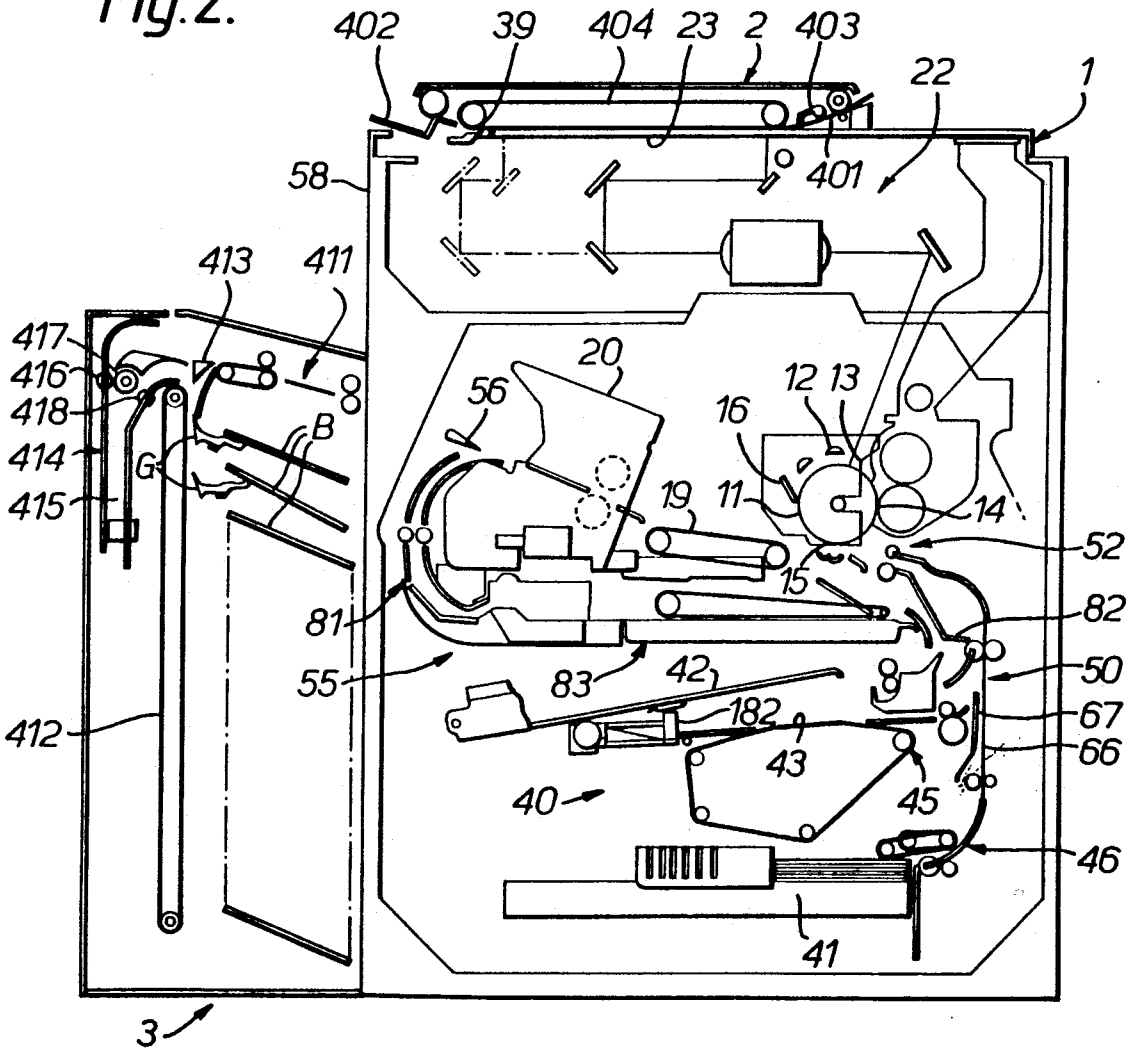
FIG. 2 is a schematic side elevational view of a copying machine like that shown in FIG. 1 incorporating a semi-automatic document handler and sorter.
Figure 3:
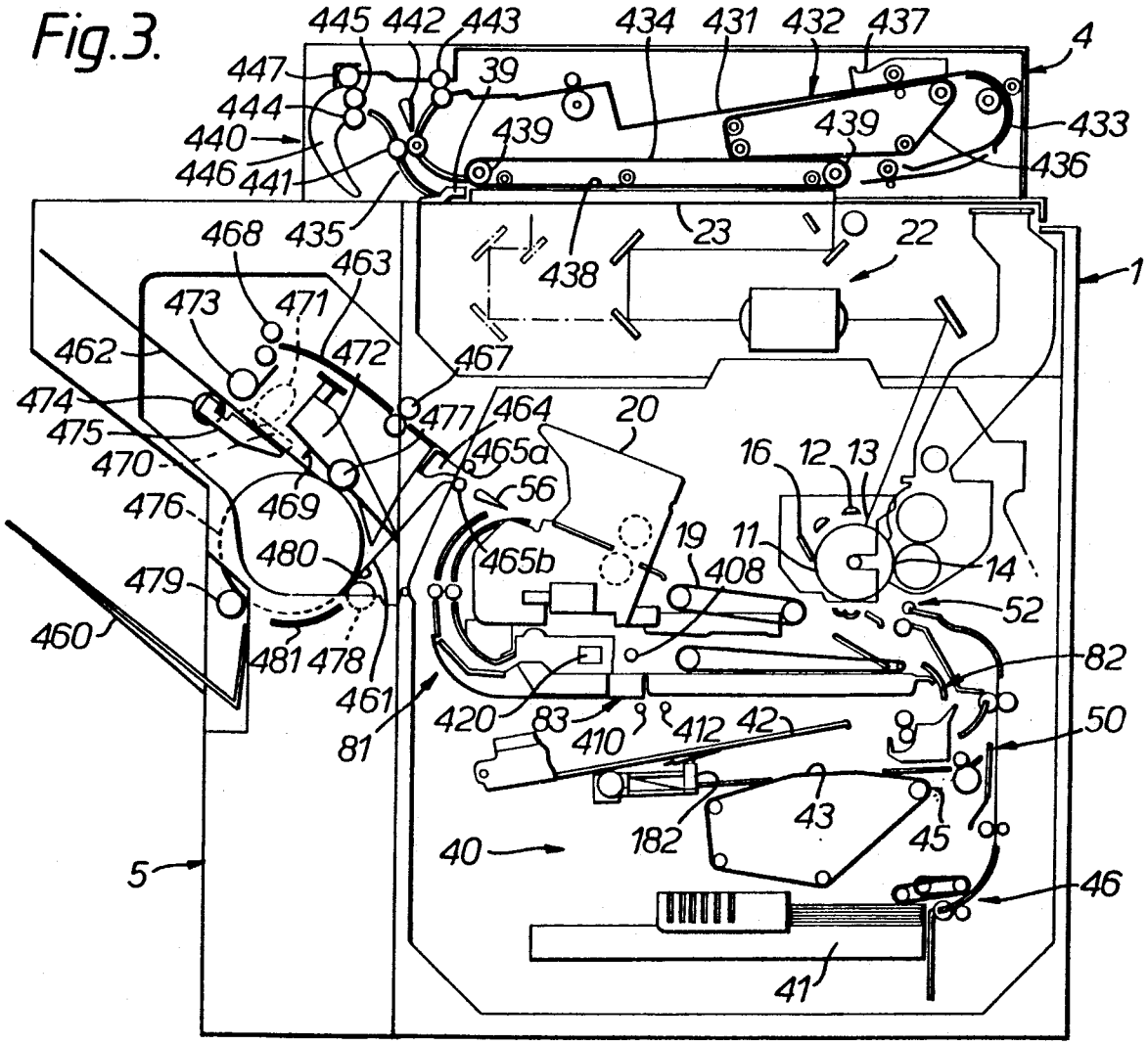
FIG. 3 is a schematic side elevational view of a copying machine like that shown in FIG. 1 incorporating an automatic recirculation document handler and a copy finisher.

Referring to FIG. 1, there is shown a xerographic copying machine 1 incorporating an embodiment of the present invention suitable for duplex copying, that is for producing copies printed on both sides, as well as for producing simplex (single-sided) copies. As will be described in detail hereinafter, a copier as illustrated may be used to produce collated duplex copies either by post-collation, preferably using a semi-automatic document handler 2, with the copies collected in a sorter 3 as shown in FIG. 2, or by pre-collation using an automatic recirculation document handler 4 and a copy finisher 5 as shown in FIG. 3. An offsetting catch tray or simplex catch tray 6 as shown in FIG. 1 may be used in place of the output devices of FIG. 2 and 3 although in the embodiment of FIG. 2 collation would not then be achieved.

The copying machine 1 includes a photoreceptor drum 11 mounted for rotation (in the clockwise direction as seen in FIG. 1) to carry the photoconductive imaging surface of the drum sequentially through a series of xerographic processing stations: a charging station 12, an imaging station 13, a development station 14, a transfer station 15, and a cleaning station 16.

The charging station 12 comprises a corotron which deposits a uniform electrostatic charge on the photoreceptor. A document to be reproduced is positioned on a platen 23 and scanned by means of a moving optical scanning system to produce a flowing light image on the drum at 13. The optical image selectively discharges the photoconductor in image configuration, whereby an electrostatic latent image of the object is laid down on the drum surface. At the development station 14, the electrostatic latent image is developed into visible form by bringing into contact with it toner particles which deposit on the charged areas of the photoreceptor. Cut sheets of paper are moved into the transfer station 15 in synchronous relation with the image on the drum surface and the developed image is transferred to a copy sheet at the transfer station 15, where a transfer corotron 17 provides an electric field to assist in the transfer of the toner particles thereto. The copy sheet is then stripped from the drum 11, the detachment being assisted by the electric field provided by an a.c. de-tack corotron 18. The copy sheet carrying the developed image is then carried by a transport belt system 19 to a fusing station 20.

After transfer of the developed image from the drum, some toner particles usually remain on the drum, and these are removed at the cleaning station 16. After cleaning, any electrostatic charges remaining on the drum are removed by an a.c. erase corotron 21. The photoreceptor is then ready to be charged again by the charging corotron 12, as the first step in the next copy cycle.

The optical image at imaging station 12 is formed by optical system 22. A document (not shown) to be copied is placed on platen 23, and is illuminated by a lamp 24 that is mounted on a scanning carriage which also carries a mirror 26. Mirror 26 is the full-rate scanning mirror of a full and half-rate scanning system. The full-rate mirror 26 reflects an image of a strip of the document to be copied onto the half-rate scanning mirrors 27. The image is focussed by a lens 28 onto the drum 11, being deflected by a fixed mirror 29. In operation, the full-rate mirror 26 and lamp 24 are moved across the machine at a constant speed, while at the same time the half-rate mirrors 27 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan. Alternatively, the optical system 22 may be fixed in position and the document scanned by being advanced across it by the document handler 2 or 4 as described below.

At the development station 14, a magnetic brush developer system 30 develops the electrostatic latent image. Toner is dispensed from a hopper 31 by means of a rotating foam roll dispenser 32, into developer housing 33. Housing 33 contains a two-component developer mixture comprising a magnetically attractable carrier and the toner, which is brought into developing engagement with drum 11 by a two-roller magnetic brush developing arrangement 34.

The developed image is transferred, at transfer station 15, from the drum to a sheet of copy paper (not shown) which is delivered into contact with the drum by means of a paper supply system 40. Paper copy sheets are stored in two paper trays; a lower, main tray 41 and an upper, auxiliary tray 42. Also provided is a dedicated duplex tray or buffer tray 43 which, during duplex copying receives simplex copies, i.e. those which have been printed on one side only, and which are subsequently re-fed from the buffer tray back to the photoreceptor to receive a second image on the other side to form the duplex copies. As will be explained in more detail hereinafter, the upper, auxiliary tray 42 and the buffer tray 43 have a common bottom sheet feeder 45 and the auxiliary tray is pivotable between an operative position in which it lies within the buffer tray and a raised inoperative position in which sheets may be received in the buffer tray. Paper sheets are fed from the main tray 41 by a top sheet separator/feeder 46. Sheets from each of the trays are directed along pre-transfer paper transport path 50 for registration at a registration point 52. Once registered, the sheet is fed into contact with the drum in synchronous relation to the image so as to receive the image at transfer station 15.

As shown in FIG. 1, the sheet transport from the main tray 41 to the photoreceptor comprises the sheet separator feeder 55 which includes take-away nip rolls 60, 61 which drive a sheet into contact with a pre-transfer guide member 66 which turns the sheet upwardly through 90° . into the nip of lower transport rolls 62, 63 by which the sheets are conveyed vertically between outer guide 66 and an inner guide 67 into the nip of upper transport rolls 64, 65 by which sheets are conveyed to the registration point 52. Sheets from the buffer tray 43 or auxiliary tray 42 are conveyed into the nip of upper transport rolls 64, 65 by upper tray take-away rolls 68, 69. Operation of the transport is initiated by the machine logic and controlled by an input microswitch 53 arranged at the upper transport rolls 64, 65.

The copy sheet carrying a transferred image on one or both sides as the case may be is transported by means of vacuum transport belt 19 to fuser 20, which is a heated roll fuser. The image is transferred to the copy sheet by the heat and pressure in the nip between the two rolls 36, 37 of the fuser. The copy is then fed from the fuser either to catch tray 6, which as mentioned is suitably an offsetting catch tray, via output nip rolls 54 or is returned to the buffer tray 43 along a sheet return or duplex path 55 depending upon the position of a diverter 56 arranged at the output of the fuser 20. This return path 55 is folded back upon itself at the exit from the fuser 20 to form curved guide portion 81 and again at the entrance to the buffer tray 43 along curved guide portion 82, the two portions 81 and 82 being connected by a horizontal portion 83 extending beneath the fuser 20, the transport belt 19 and the photoreceptor 11. Simplex sheets stored in the buffer tray 43 are fed out from the tray in the opposite direction to that in which they enter the tray. Because of the double folded arrangement of the sheet return path 55, sheets fed out of the buffer tray 43 to the pre-transfer paper transport 50 will be the same way up as when they passed the photoreceptor 11 so that they are correctly positioned to receive an image on the other side thereof. This is because the pre-transfer transport 50 inverts the sheets as they are conveyed to the photoreceptor.

After transfer of each developed image from the drum to the copy sheet the drum surface is cleaned at cleaning station 16 which includes a doctor blade mounted within a housing. The doctor blade scrapes residual toner particles off the drum, and the scraped-off particles then fall into the bottom of the housing where they are removed by an auger (not shown).

The elements of the copier are carried by a frame 57 and are all enclosed by a cover 58 having a front access door; the catch tray 6 of FIG. 1 protrudes through the side cover. The copier is suitably mounted on castors. The platen 23 is covered by a hinged top cover 59 which can be raised for access to the platen. The cover 59 may, as in FIG. 2, incorporate a semi-automatic document handler 2 by which copies inserted manually at one side are automatically fed onto the platen 23 for copying and then fed off the platen after copying, or as in FIG. 3, an automatic recirculation document handler 4 by which documents arranged in a stack are fed onto the platen one at a time for copying and then returned to the stack after copying. The copier may also have a sorter 3 as shown in FIG. 2 or a finisher 5 as shown in FIG. 3 arranged to receive copies from the output nip rolls 54.

Following transfer at the photoreceptor 11, sheets are conveyed by vacuum transport 19 to the fuser 20 through which they are driven by the fuser nip rolls 36, 37. Sheets exiting the fuser are directed by diverter 56 to the output device via the exit nip rolls 54 or to the duplex sheet return path 55 to the buffer storage tray 43. The sheet return path 55 (FIG. 4) includes a first inversion guide 81 by which a simplex sheet being conveyed to the buffer tray is inverted once as its direction of travel is changed to convey it horizontally along the horizontal guide 83 beneath the fuser 20, the horizontal transport 19 and the photoreceptor 11 in the opposite direction to its travel past the photoreceptor and through the fuser. At the end of the horizontal path 83 the sheet enters curved guide 82 which again inverts the sheet and guides it into the buffer tray 43. It will be noted that between the photoreceptor 11 and the buffer tray 43 the sheet is inverted twice so that it enters the buffer tray in the same orientation that it left the photoreceptor. Simplex sheets to be duplex copied are fed out of the buffer tray 38 from left to right as shown in FIG. 1, i.e. in the opposite direction to which they enter the tray and in the same direction in which virgin sheets are fed, and returned by the pre-transfer paper path 50 to the photoreceptor. It will be noted that between the buffer tray 43 and the photoreceptor, the simplex sheet is turned through approximately 180° and this inversion of the sheet causes the blank side of the simplex sheet to be presented to the photoreceptor to receive a second image. It will be understood that with this arrangement the sheets are inverted three times between leaving the photoreceptor and re-passing the photoreceptor during duplex copying. This is achieved without the provision of a special inverter but rather by natural inversion as they are conveyed along the duplex return path 55 and pre-transfer paper path. The double folded configuration of the duplex return path 55 permits a particularly compact arrangement of copier while enabling the paper trays 41, 42, 43 all to be arranged in close array thus simplifying operator access and at the same time permitting a common feeder 45 for the buffer tray 43 and the auxiliary tray 42.

In its passage through the sheet return path 55 each sheet passes through a de-curler mechanism 350 arranged at the beginning of the horizontal guide 83 and is offset laterally as it travels along the horizontal guide 83 by an offsetting mechanism 370.

The diverter 56 is always positioned to divert sheets to the output nip rolls 54 when simplex copying is selected. During duplex copying its position varies according to a predetermined sequence in order to ensure that completed copies exit to the output tray 6 while incomplete copies are conveyed along the sheet return path 55. It is controlled by the machine's microprocessor and actuated by a microswitch 49 triggered by the lead edge of a copy as it enters the fuser. The curved guide 81 of the sheet return path 55 includes inner and outer guide members 84 and 85 and nip rolls 86. The diverter 56 is mounted at the upper end of the outer guide 85 and is operated by a cable 87 from a solenoid 88 mounted lower down on the outer guide 85. The outer guide 85 is hinged to the copier frame for access to the paper path 55.

As the copy passes through the fuser 20 the soft heater roll 36 and the hard pressure roll 37 tend to bend the paper so that it becomes curled with the image side on the outside of the curve. It is important to remove this curl so far as possible from the sheet before it enters the buffer tray so as to avoid handling problems. To this end the sheets conveyed along the return path 55 pass through the sheet de-curler 350 which is arranged at the entrance of the horizontal guide 83. The de-curler 350 comprises of a pair of coacting rolls 351, 352 and associated baffle means 353 so positioned relative to the sheet path that a sheet passing through the de-curler mechanism is bent around the lower roll 352 and has induced in it a degree of curl sufficient approximately to offset the opposite curl induced in the fuser.

Figure 5:
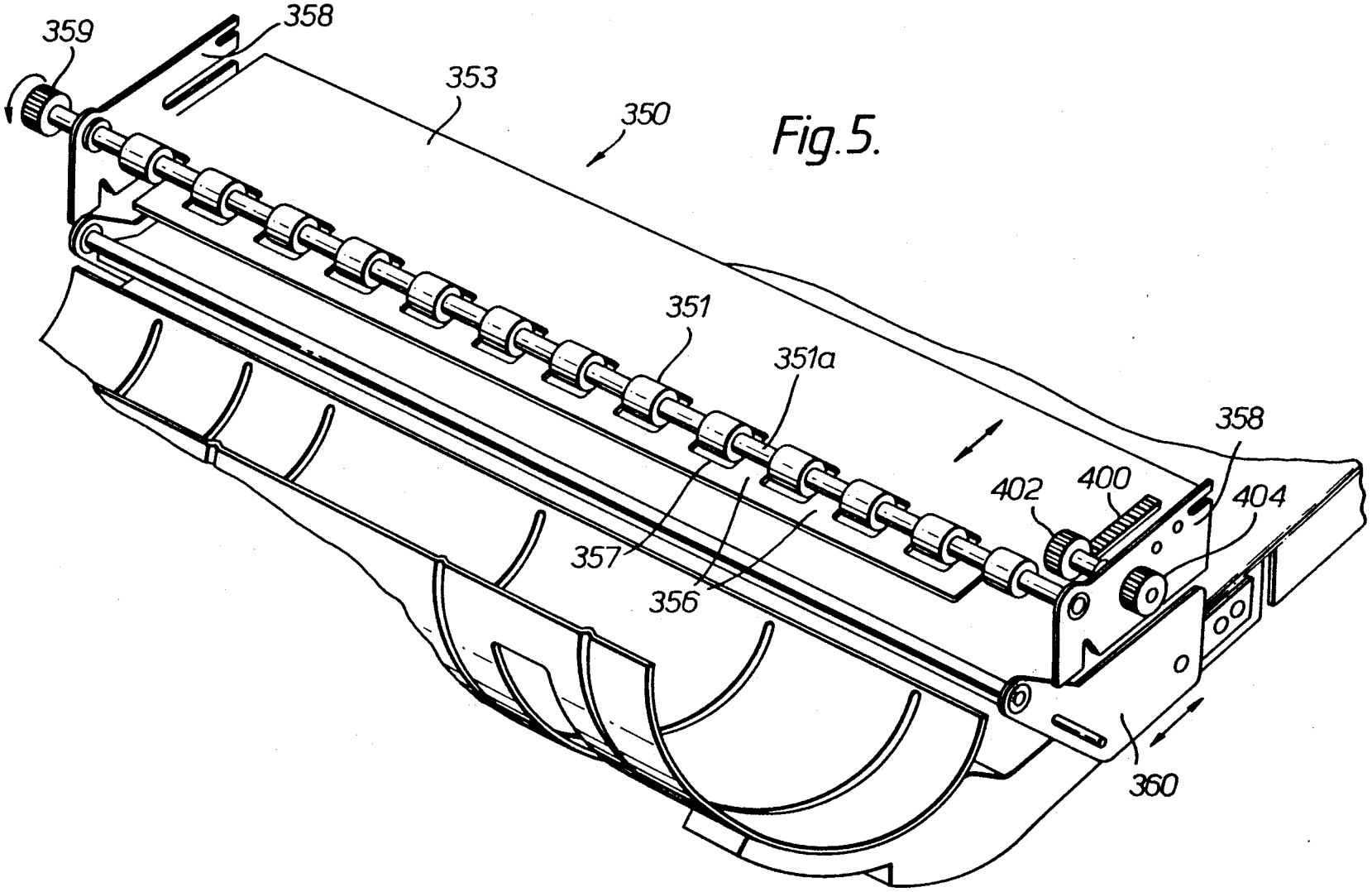
FIG. 5 is a perspective view of a sheet decurler mechanism arranged in the sheet return path.
Figure 6:
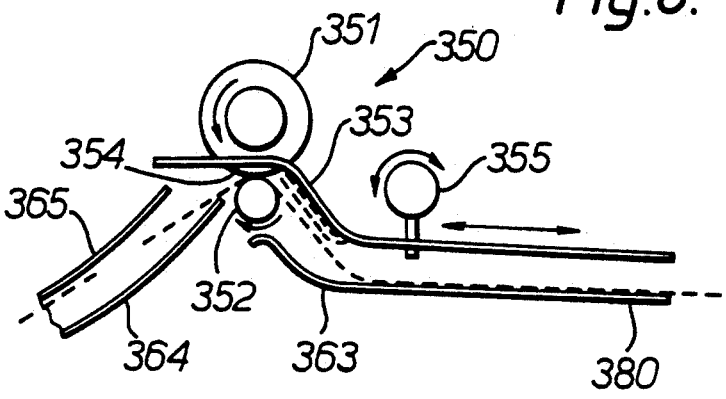
FIG. 6 is a cross-section through the sheet decurler of FIG. 5.

As best shown in FIGS. 5 and 6 the de-curler mechanism 350 comprises a small radius hard roll 352 such as a metal (steel) shaft engaged by a relatively soft upper roll 351, for example having a compressible rubber surface which is spring loaded into engagement with the lower roll 352 forming a nip 354. The baffle 353 extends downwardly at the downstream side of the nip 354 and is arranged to deflect the sheet downwardly and control the degree of wrap around the lower roll which in turn controls the degree of de-curl. The position of the baffle 353 is adjustable in the feed direction of the sheet, i.e. horizontally as illustrated between for example positions shown in broken and full lines in FIG. 34, for adjusting the degree of paper wrap around the lower roll 352. A suitable adjustment mechanism, is illustrated schematically at 355, is provided for this purpose.

The adjustment mechanism may take a number of forms and, by way of example, is shown in FIG. 5 in the form of a rack and pinion arrangement. The rack 400 is a toothed bar mounted on the upper surface of the baffle 353, the toothed bar meshing with the teeth of the pinion 402. The pinion 402 is driven by a gear wheel 404, connected thereto by a rotatable shaft, mounted on an opposite side of the fixed bracket 358. The gear wheel 404 is driven in a conventional manner by a gear train (not shown) coupled to the drive shaft of a stepping motor.

It will be understood if the upper roll 351 were continuous the lead edge of the baffle 353 would be positioned adjacent the periphery of the upper roll and particularly where the baffle is adjustable the gap between the roll and the baffle lead edge provides the possibility for sheets passing through the nip 354 to travel over the baffle rather than under it. In order to avoid this possibility the upper roll 351 is made non-continuous by arranging a series of spaced rubber rollers 351 on a steel shaft 351*a* and the baffle is provided with lead-in tangs 356 extending between the rollers. In the embodiment shown these tangs are interconnected on the upstream side of the rollers by a cross-portion 357.

The lower roll 352 of the de-curler mechanism is suitably a steel shaft having a diameter of about 8 mm while the upper roll 351 suitably comprises a steel shaft 351*a* having Neoprene rollers about 16 mm in diameter mounted thereon.

The baffle 353 is suitably arranged at an angle of between 25° and 40° to the vertical and the horizontal spacing between the surface of the lower roll 352 and the baffle along the center line of the roll may be set between 1.0 mm and 10 mm depending upon the angle of the baffle and the weight of the paper. Thus in one embodiment the angle of the baffle may be 33° and the roll to baffle spacing 7.7 mm.

As shown in FIG. 5 the upper roll 351 is mounted on the fixed bracket 358 attached to the copier frame and driven through a gear 359. The lower roll 352 is mounted on a lower support bracket 360 which is pivoted at 361 and urged upwardly by a leaf spring 362 to press the lower roll against the upper roll.

At the exit from the de-curler 350 a post de-culer guide 363 returns the sheet to the horizontal and it will be noted that in order to limit the vertical separation of the sheet path at the opposite sides of the de-curler the input guides 364, 365 at the ends of the guide members 84, 85 direct a sheet upwardly into the de-curler mechanism. Sheets are driven by the de-curler rolls 351, 352 along a horizontal support surface 380 beneath a horizontal transport belt 381 entrained about rollers 382, 383 and a pinch roller 384 within the belt run presses the lower run of the belt against a roller 385 projecting through the support surface 380 to ensure drive engagement between the belt and the sheets.

At the downstream end of the belt 381 is arranged the offsetting mechanism 370. A pair of outrigger rolls 371 are provided on the downstream belt guide roll (383) shaft 386 and engage with a pair of skew rolls 372 which are arranged at an angle to the path of sheet travel. These rolls skew sheets passing therethrough thus have the effect of offsetting the sheets towards the rear of the copier.

Figure 4:
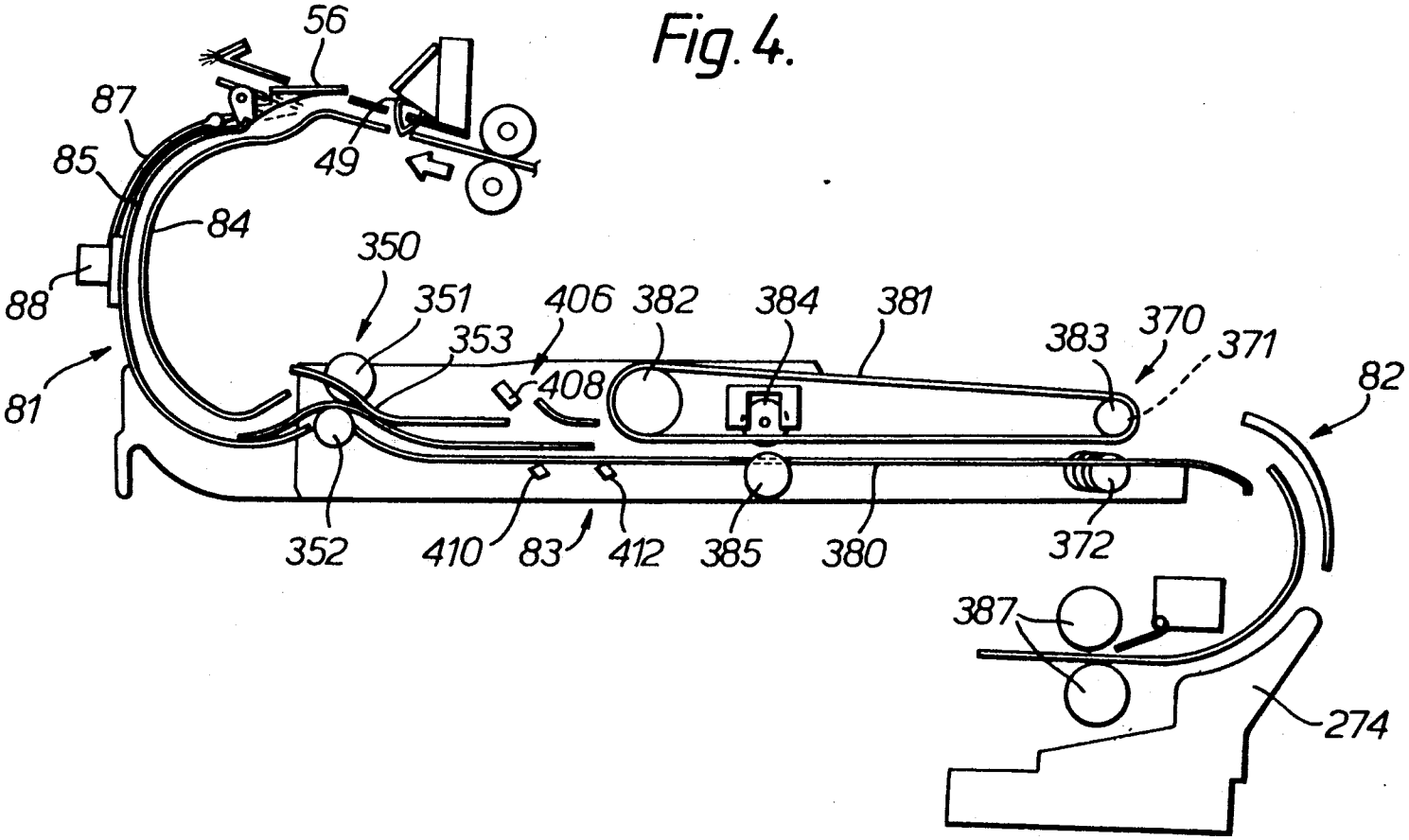
FIG. 4 is a schematic side elevation of the post-transfer and return paper paths.
Figure 9:
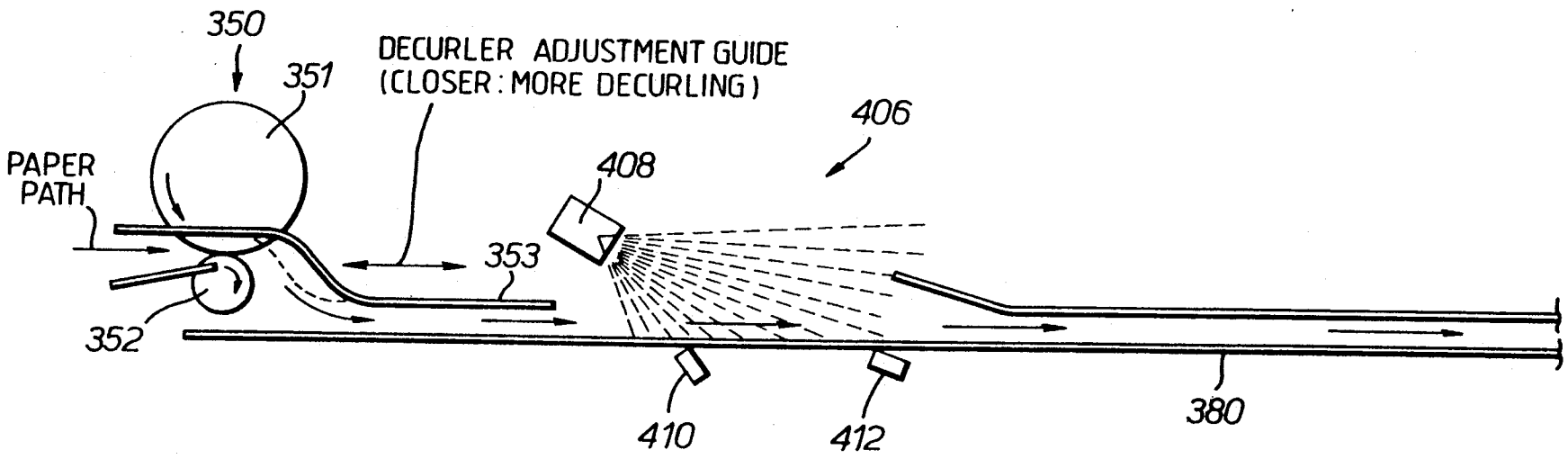
FIG. 9 is a schematic illustration of the curl sensing device downstream of the decurle.
Figure 10:
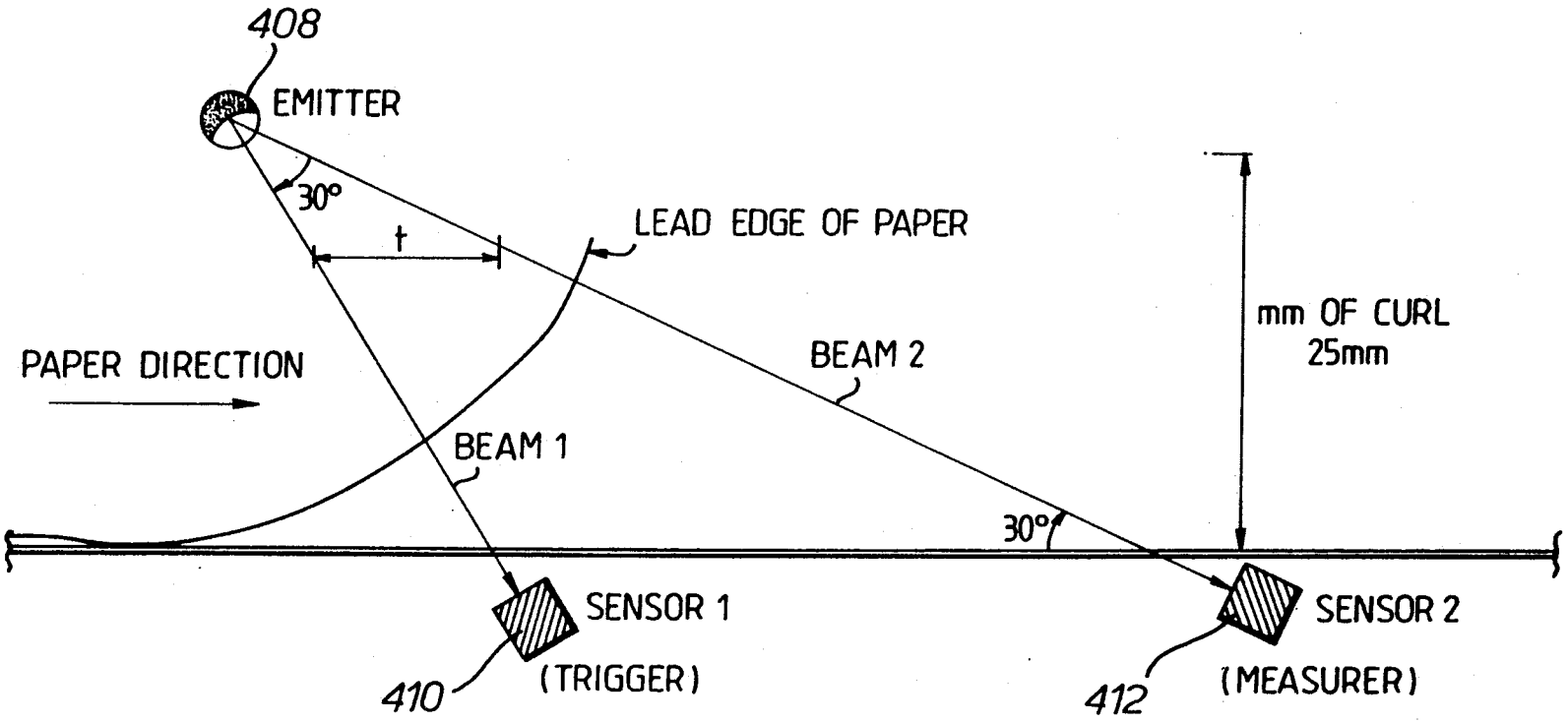
FIG. 10 is an illustration of curl detection at the curl sensing device.

Referring to FIG. 4, and as best seen in FIG. 9, the curl sensing device 406 comprises a radiation source, in the form of an infra-red emitter 408, and two detectors, in the form of infra-red sensors 410 and 412 for detecting radiation emitted by the emitter 408. The sensors 410 and 412 are spaced apart adjacent a horizontal section of sheet path downstream of the decurler 350, and are arranged whereby movement of the sheet material along the sheet path downstream of the decurler 350 causes the light beams reaching the sensors 410 and 412 to be interrupted in succession by the feed edge of the sheet material. The time interval between interruption of the light beams at the sensors 410 and 412 is a function of the extent of residual curl in the sheet material. In the embodiment shown in FIGS. 4 and 9 the emitter 408 is located above the straight section of sheet path downstream of the decurler 350 and the sensors 410 and 412 are spaced apart below the sheet path. For an upward curl like that illustrated in FIG. 10 the time interval between interruption of light at the sensors 410 and 412 is inversely proportional to the size of the curl in the sheet.

Figure 8:
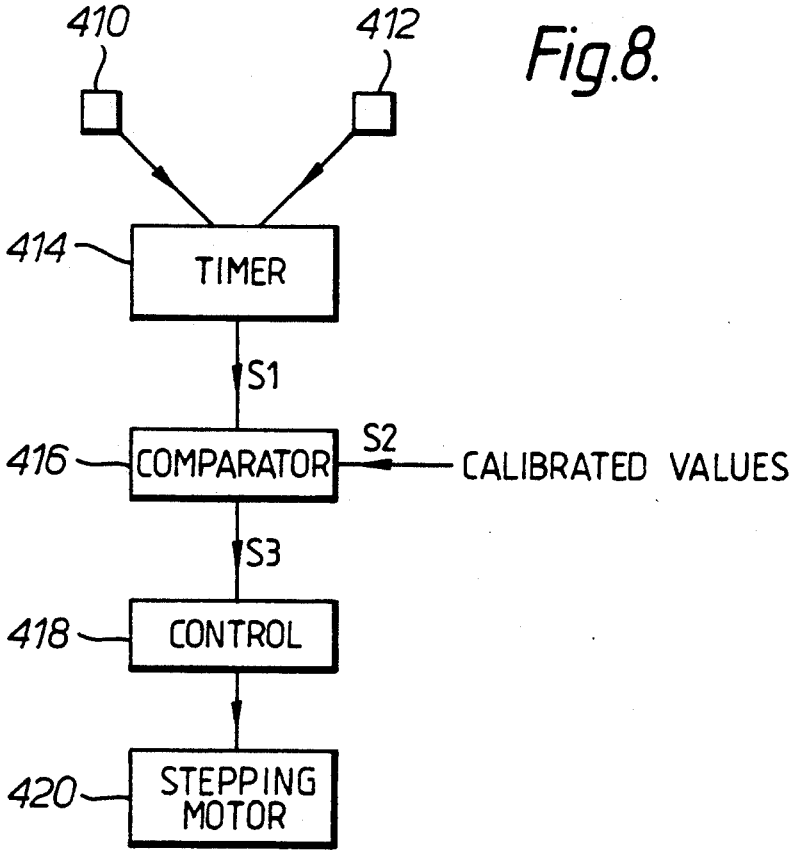
FIG. 8 is a block diagram illustrating the processing of the sensed signals.
Figure 7:
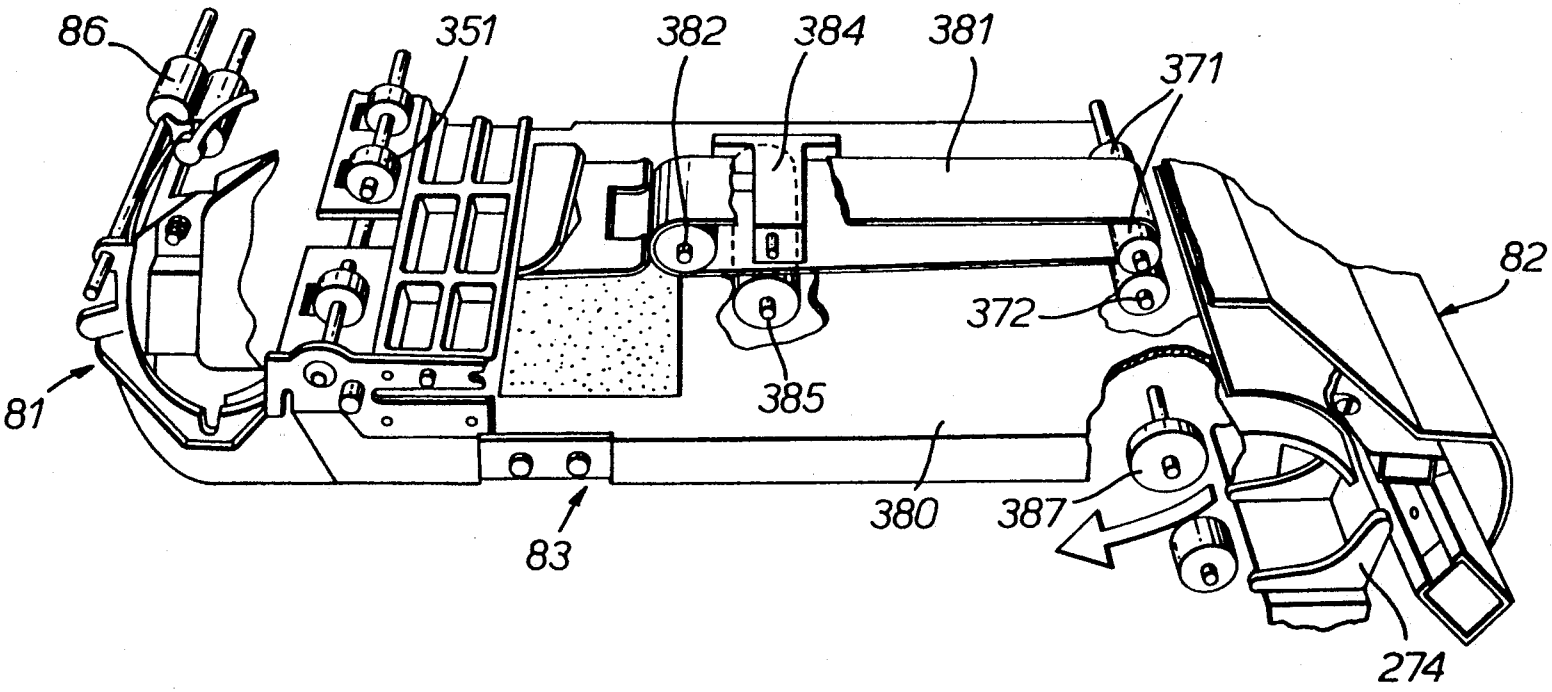
FIG. 7 is a perspective view partly broken away of the sheet return path.

The time interval between the interruption of the light at the sensors 410 and 412 is measured at a timer 414 (FIG. 8) which transmits a signal S1 indicative of that time interval to a comparator 416. The comparator 416 compares the signal S1 with a calibrated signal S2 representative of a sheet having no residual curl. The difference between the signals S1 and S2 determines the characteristics of a signal S3 which is fed to control means 418 for controlling a stepper motor 420. In response, the stepper motor 420 turns its drive shaft a predetermined number of steps which motion is transmitted by conventional mechanical coupling to the gear wheel 404 (FIG. 5) and hence to the pinion 402 to adjust the position of the baffle 353 along the feed direction of the sheet. The baffle 353 is mounted for reciprocal movement along the horizontal.

Tests have shown that the maximum curl occurs at the corners of a sheet so it is advantageous to position the sheet curl control apparatus at the datum edges and where lead edge curl measurement can be taken.

Although a specific embodiment of the invention has been described hereinabove it will be realized that various modifications may be made to the specific details referred to without departing from the scope of the invention as defined in the appended claims.

For example, the sheet curl control apparatus of the present invention is not only applicable to the field of xerography but would also find application in other fields, for example the feeding of banknotes in an ATM. Likewise the sensing means may take a form different to that described above and/or may be arranged differently in relation to the path of the sheet.

I claim:

1. A sheet curl control apparatus including a decurler for reducing the curl in sheet material passing therethrough and adjusting means coupled to the decurler for adjusting the decurling action of the decurler, characterized by sensing means for sensing the extent of any residual curl left in the sheet material after it has passed through the decurler, and for feeding a signal indicative of the residual curl to control means for automatically adjusting said adjusting means thereby to alter the decurling action of the decurler in a predetermined manner, and wherein said sensing means comprises a radiation source and two radiation detectors for detecting radiation emitted by said radiation source, said radiation detectors being spaced apart and arranged such that movement of the sheet material along the sheet path downstream of said decurler causes the light beams reaching the detectors to be interrupted in succession by the feed edge of the sheet material, the time interval between interruption of the light beams at the two detectors being a function of the extent of residual curl in the sheet material.

2. The sheet curl apparatus as claimed in claim 1, wherein said sensing means is located adjacent a straight section of sheet path downstream of said decurler.

3. The sheet curl apparatus as claimed in claim 2, wherein said sensing means is located adjacent a horizontal section of sheet path downstream of said decurler.

4. The sheet curl apparatus as claimed in claim 1, wherein said radiation source is located on one side of said straight section of sheet path downstream of said decurler and the detectors are spaced apart on the opposite side of the sheet path.

5. The sheet curl apparatus as claimed in claim 4, wherein said radiation source is positioned above the sheet path and the detectors are positioned below the sheet path, the time interval between interruption of light at the detectors being inversely proportional to the sheet curl.

6. The sheet curl apparatus as claimed in claim 5, wherein said radiation source is an infra-red emitter and said detectors are each infra-red sensors.

7. The sheet curl apparatus as claimed in claim 6, wherein said control means includes a motor with a drive shaft operable in response to a feedback signal from said sensing means to adjust said adjusting means.

8. The sheet curl apparatus as claimed in claim 7, wherein said adjusting means is a rack and pinion arrangement, said rack being mounted to a baffle of said decurler and said pinion being driven by a mechanical coupling arrangement to said drive shaft of said motor.

9. The sheet curl apparatus as claimed in claim 8, wherein said motor is a stepping motor.

10. A copier defining therein a sheet path having a sheet curl control apparatus arranged therealong including a decurler for reducing the curl in sheet material passing through the decurler, lead-in guide means for guiding the sheet material into the decurler and adjusting means coupled to the decurler for adjusting the decurling action of the decurler, characterized in that said sheet curl control apparatus includes sensing means for sensing the extent of any residual curl left in the sheet material after it has passed through said decurler, and for feeding a signal indicative of the residual curl to control means for automatically adjusting said adjusting means thereby to alter the decurling action of the decurler in a predetermined manner, and wherein said sensing means comprises a radiation source and two radiation detectors for detecting radiation emitted by said radiation source, said radiation detectors being spaced apart and arranged such that movement of the sheet material along the sheet path downstream of said decurler causes the light beams reaching the detectors to be interrupted in succession by the feed edge of the sheet material, the time interval between interruption of the light beams at the two detectors being a function of the extent of residual curl in the sheet material.

11. A copier for duplex copying including a photoreceptor, a copy sheet tray, a duplex buffer tray, sheet feeders associated with said trays for feeding sheets from said trays to the photoreceptor, a fuser for fixing images received on said sheets at the photoreceptor, a sheet return path for conveying simplex sheets which have received an image on one side at the photoreceptor to said duplex buffer tray from said fuser for refeeding to the photoreceptor to receive a second image on the other side and a sheet curl control apparatus in the sheet return path, characterized in that said sheet curl control apparatus includes sensing means for sensing the extent of any residual curl left in the sheet material after it has passed through a decurler, and for feeding a signal indicative of the residual curl to control means for automatically adjusting said adjusting means thereby to alter the decurling action of said decurler in a predetermined manner, and wherein said sensing means comprises a radiation source and two radiation detectors for detecting radiation emitted by said radiation source, said radiation detectors being spaced apart and arranged such that movement of the sheet material along the sheet path downstream of said decurler causes the light beams reaching the detectors to be interrupted in succession by the feed edge of the sheet material, the time interval between interruption of the light beams at the two detectors being a function of the extent of residual curl in the sheet material.

* * * * *